United States Patent [19]

Brandes et al.

[11] Patent Number: 4,511,053

[45] Date of Patent: Apr. 16, 1985

[54] LID FOR A CONTAINER NECK PROVIDED WITH A THREAD OR UNDERCUT SHOULDER

[75] Inventors: Carlos E. Brandes, Worms; Gunter Spatz, Biblis, both of Fed. Rep. of Germany

[73] Assignee: Alcoa Deutschland GmbH, Worms, Fed. Rep. of Germany

[21] Appl. No.: 467,081

[22] Filed: Feb. 16, 1983

[30] Foreign Application Priority Data

Feb. 20, 1982 [DE] Fed. Rep. of Germany ..... 3206245
Jul. 23, 1982 [DE] Fed. Rep. of Germany ..... 3227510

[51] Int. Cl.[3] ..... B65D 41/34
[52] U.S. Cl. ..... 215/252
[58] Field of Search ..... 215/252

[56] References Cited

FOREIGN PATENT DOCUMENTS

| | | | |
|---|---|---|---|
| 2700322 | 7/1978 | Fed. Rep. of Germany . | |
| 34997 | 9/1981 | Fed. Rep. of Germany . | |
| 2290364 | 6/1976 | France | 215/252 |
| 2291915 | 6/1976 | France | 215/252 |

*Primary Examiner*—Donald F. Norton
*Attorney, Agent, or Firm*—Staas & Halsey

[57] ABSTRACT

A two-piece lid for closure of a container neck with a thread or undercut shoulder having a lid member formed of a metal and a separate safety ring formed of synthetic material. The ring has an upper part and lower part, with the upper part positioned inside a sidewall protrusion which is provided at the lower edge of the lid member. In order to make the safety ring undamageable, the ring can be shrinkable in its lower part. On the other hand, the upper part of the safety ring can be formed as an outwardly directed edge and the lower part can be formed as an inwardly obliquely directed lip, so that the ring has a substantially Z-shaped cross-section. In both cases, there are no parts protruding over the protrusion of the lid member, where the ring could be damage unintentionally. If the safety ring also is stressed, either by separated elongation tongues on the inside of the lower part or by deformation of the upper part of the ring obliquely upwardly into the inside of the lid member portion, the separated, torn open parts of the lower part will spread to the outside away from the container neck after opening of the lid. These torn open parts cannot be pushed back inwardly to mislead a following user of the lid that the container is still unopened. In order to push the lower part of the ring over the container neck with less effort during assembly, the lower part is provided with toothing facing and engaging grooving formed on the outer parts of the safety ring.

26 Claims, 8 Drawing Figures

LID FOR A CONTAINER NECK PROVIDED WITH A THREAD OR UNDERCUT SHOULDER

BACKGROUND OF THE INVENTION

This invention relates to a lid for a container neck provided with a thread or undercut shoulder and method of assembling same.

An undamageable lid for bottles, phials and similar vessels is known from German 1978 patent publication 27 00 322 which consists of one integral piece of synthetic substance. The lid has a safety ring joined to the main lid member by a ring shaped region of weak resistance which is likely to break from the pulling force during the first opening of the vessel. Since this lid consists of one single piece of synthetic material, production complications may occur, as the lid with its relatively rough form also encloses the delicate safety ring. Using an injection manufacturing process, this results in an inequality between the required injection times for the lid member itself and for the safety ring. Moreover, lids of synthetic material are not always suitable for bottle closures, especially for beverages having high carbon dioxide pressures. The more pressure tight metal lids are preferable for such beverage closures.

Indeed, metal lids are known, of which the lower edge is joined to a metal ring by way of joining strips, which break when the lid is unscrewed, so that the metal ring stays on the bottle neck. However, the disadvantage of such a lid is that after opening the metal lid and breaking of the joining strips, sharp metal edges may result, increasing the risk of injury for the user. Also, such metal lids are only applicable on container necks with small fabrication tolerances, because of the inflexibility of the dimensions of the metal lid.

A closure member for a container neck provided with a thread or undercuts is known from the French 1976 patent publication No. 22 91 915, comprising:

(a) a lid member having a protrusion to the outside at the lower edge, which is flanged to the inside in order to fit or accommodate; and (b) a ring of synthetic material comprising an upper part, joined to a lower part by way of a region of reduced resistance in the direction of the circumference, the upper part providing a ledge to fit into the protrusion of the lid.

Furthermore, the lower part of the ring has a lip, protruding obliquely inwardly in an upward direction to act against the shoulder of the bottle; on the outside of the lower part of the ring, however, a ledge, which supports itself against an outwardly flanged part of the lower edge of the lid member, is attached to this lip of the ring.

This double part arrangement of the lid permits the choice of material for the two parts to be independent of each other. Therefore, the lid or cap itself can consist of metal in particular, while the safety ring can comprise a synthetic material.

When unscrewing the lid, the outwardly protruding ledge of the upper part of the ring is supposed to support against the ring-channel-shaped flanged protrusion of the lower edge of the lid member, so that by means of a lever action of the ring ledge, the lower part of the ring is prevented from giving way to the outside; otherwise, the lip of the ring of synthetic material would give way at the outside of the shoulder of the container neck, preventing the upper and lower parts of the ring from tearing apart along the region of reduced resistance. Simultaneously, the metal lid or cap without the rigid, ring-channel-shaped flanged protrusion would experience an unevenly spread extension over its circumference. This is even more significant when the metal lid or cap with the ring of synthetic material is pulled over the container neck. A certain clearance between the ring, particularly the inwardly protruding lip, and the circumference of the container neck has to be maintained exactly because of this lever-like cooperation between the ledge and the edge of the metal lid or cap. With a lid or cap made entirely of synthetic material, which itself is already flexible, the conditions are even more unfavorable. This supporting ledge of the ring on the outside of the ring lip costs material. Moreover, the ring of synthetic material may also unintentionally be torn open at this point, as it protrudes over the edge of the lid member; this would erroneously indicate an opened bottle.

Compared with this, a one piece cap or lid of synthetic material is known from European 1981 patent publication No. 0 034 997. The safety ring of the lid can be shrunk by way of heat treatment to the container neck below the shoulder of the neck. However, such a lid or cap of synthetic material provides the same disadvantages mentioned above.

By contrast, the present invention provides a lid or cap with a separated safety ring of synthetic material, so that the materials of the lid member and ring can be chosen independently of each other. Moreover, the safety ring of synthetic material is not torn unintentionally before the lid is open.

Thus, a first embodiment of a lid for a container neck having a thread or undercut shoulder in accordance with this invention comprises:

(a) a lid member (1), in particular of metal, having a protrusion (4) to the outside at the lower edge (3) in order to shape the inside to fit or accommodate; and (b) a ring of synthetic material (7) comprising an upper part (23), joined to a lower part (24) by means of a region (25) of reduced tearing resistance during opening of the lid in the direction of the circumference (12), the upper part (23) providing a protrusion to fit into the protrusion (4) of the lid member (1) and the lower part (24) providing a lip (26) protruding obliquely and inwardly towards the container neck shoulder. The outer protrusion at the upper part (23) of the ring (7) of synthetic material is in the form of a ridge (8) directed to the outside and the lower part (24) of the ring (7) of synthetic material has no protrusion to the outside so that the ring (7) has a substantially Z-shaped cross section.

With this construction, the safety ring of synthetic material has the form and effect of a grapple hook. This ensures tearing of the ring when opening the lid. Thus, it does not matter that the ring of synthetic material is a bit larger than the container neck, so that it can be pulled over the neck without much effort. Also material is saved, as there is no voluminous outer ledge provided for the ring at the lower part thereof. As this outer ring ledge is omitted, there is no possibility of tearing the ring unintentionally before the lid is opened.

An alternative construction for a lid for a container neck having a thread or undercut shoulder in accordance with this invention comprises:

(a) a lid member (1), in particular of metal, providing a protrusion (4) to the outside of the lower edge (3) in order to shape the inside to fit (b) a ring (7) of synthetic material comprising an upper part (23), joined to a lower part (24) by means of a region (25) of reduced tear resistance during opening of the lid in the direction of the circumference (12), the upper part (23) providing a protrusion to fit into the protrusion of the lide member (1), in which at least the lower part of the ring (7) of synthetic material is arranged to be shrinkable.

With this construction, it is not necessary to provide a lip at the lower part of the ring, protruding obliquely inwardly in an upward direction. That is, by heat-shrinking of the ring, a particularly tight form hugging enclosure of the container neck with thread or undercut, especially below the neck shoulder, is achieved by the ring and, optionally, also by the lid. It may be added that a heat-shrinkable ring of synthetic material means, in particular a ring, is already known per se from the previously mentioned European patent publication and the state of the art described therein. Additionally, the protrusion of the lid can be arranged to be heat-shrinkable. Furthermore the lid itself can, if necessary, consist of heat-shrinkable synthetic material. Thus, a particularly reliable enclosure of the container neck can be achieved.

It stands to reason that, if necessary, with a construction according to the first embodiment described above, the safety ring and/or the protrusion can be arranged to be shrinkable. Moreover, at least the lower part of the ring and, if necesary the protrusion of the lid, can additionally be arranged to be shrinkable. In that case, exceptionally large tolerances of the container neck can be provided for.

Further saving of material, with little effect on the rigidity of the safety ring and a decrease of the clearance when the safety ring is pulled over the container neck, can be obtained with a ring of synthetic material arranged wherein the lip at the lower part of the ring is provided with teeth which fit into a corresponding groove of the lower part of the ring on the side of the lip. Thus, the lip can give way even more to the outside into the outer lower part of the safety ring. Consequently the lip can give way even better to the container neck, particularly to the neck shoulder. Unintentional destruction or tearing of the safety ring, especially when being pulled over the container neck, thereby becomes more unlikely. If the lower part of the ring of synthetic material is also arranged to be shrinkable, the lip can be enclosed by the outer, lower part of the shrinking process, resulting in a practically integral lower part.

A ring of synthetic material, with weakening lines at the lower part of the ring spaced at regular intervals transversely to the circumferential direction, is preferred in all cases. Thus, the ring can break over its entire circumference and fall down from the container neck. Consequently, the lower part of the ring is prevented from staying on the container neck and saves the trouble of removing the ring afterwards, before refilling of the container.

The region of reduced resistance between the upper and the lower part of the ring of synthetic material can be formed by providing joining strips or bridges, alternately interrupted by fractures in the ring of synthetic material. Preferably, the joining strips can be arranged in the upper third and the fractures in the lower third of the ring. The weakening lines can be arranged to have V-shaped cross sections, thus without the provisions of gaps or regions of removed material.

A problem which is always possible with the previously mentioned lids is that the ring of synthetic material is not completely torn off the lid. When one then puts the lid back onto the container neck, it is possible to push the broken lower part or parts of the ring, which have remained attached to the upper part, upwardly to the upper part of the ring immediately beneath the lower edge of the lid. Thus, it would not be obvious from the lower part of the ring of the lid, which is visible from the outside, that the ring is torn open; i.e., that the container has been opened already. In order to prevent such a deception, the ring of synthetic material can be arranged in a way in which, scattered over the region of reduced resistance, at least one support bridge is arranged transversely to the circumferential direction in order to join the upper and lower parts of the ring. The lower part has at least one weakening line arranged transversely to the circumferential direction of the ring. With this arrangement, a special assembly method is also necessary, which will be described in detail later on.

The technique, wherein there are a plurality of support bridges and a weakening strip provided adjacent one of the support bridges, is further preferred. The special effect of this technique will also be explained later on.

If the ring of synthetic material is formed having the lip with at least scattered elongations, an assurance against deception is given sufficiently by the ordinary assembly method of positioning the lid around the ring and then flanging the surrounding edge of the lid around the outwardly directed ridge of the ring. The elongations of the lip will push away the torn open parts of the lower part of the ring to the outside of the container neck, especially the protruding region. Therefore, at least a few parts of the lower part of the ring spread out and cannot be bent back to the container neck and to the lower edge of the lid or cap.

In the above assembly method wherein the protrusion of the ring is inclined or slanted inwardly in the upward direction along the entire ring circumference, the upper part of the ring of synthetic material is stressed inside the protrusion of the lid, resulting from the incline of the protrusion. If the lower part of the ring is now torn open along a weakening line, transverse to the direction of the circumference, support bridges between the upper and lower part will spread out from the container neck as a result of the stress in this region of the lower part of the ring. Then, it is no longer possible to push the broken parts of the ring to the inside and up, beneath the lid. This stressing by the incline of the protrusion can be obtained by way of the above assembly method in which the inwardly flanged lower edge of the lide is pressed upwardly so that the protrusion is pressed upwardly from the bottom in a certain way. The protrusion attempts to give way to this pressure by extending in the region of the lower edge, while the diameter of the protrusion in its upper region is pressed together, i.e., it collapses inwardly. Consequently, the protrusion obtains an incline to the inside and upwardly over its circumference.

DETAILED DESCRIPTION OF THE PREFERRED EMBODIMENTS

Figure 1:
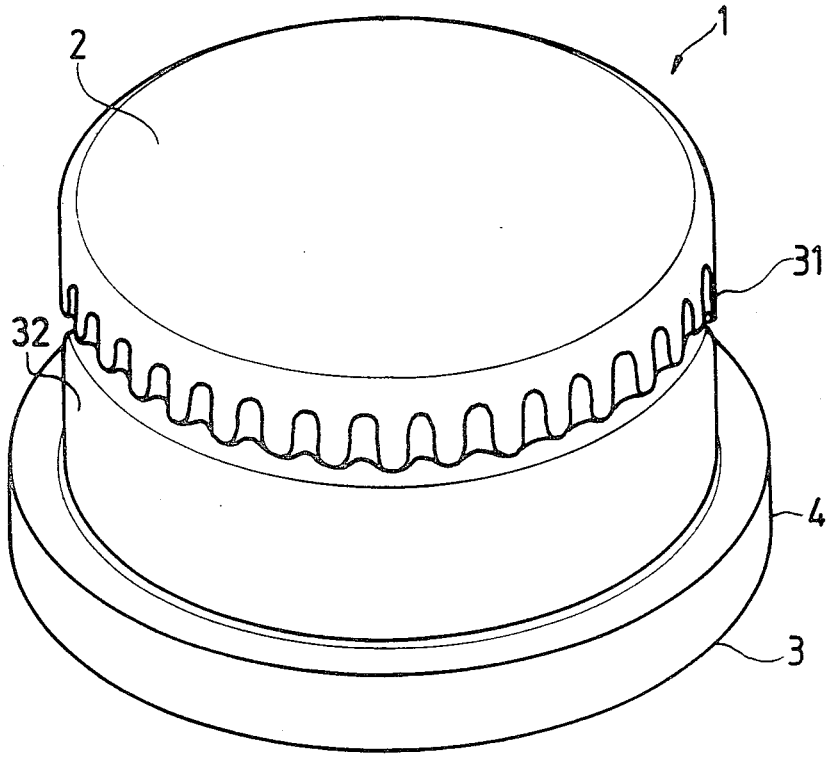
FIG. 1 is a perspective view of a lid member of metal, namely an aluminum alloy, for the lid according to the invention.

In FIG. 1, a lid member (e.g., formed of metal) is shown for the lid for a container neck according to the invention. The lid member 1 has a profiled upper edge 31 in order to facilitate twisting by the user when opening. Side 32 of the lid or cap member 1 is not yet flanged to threads of the container neck and therefore it is still smooth. An outwardly-extending protrusion 4 is provided in the side of the lid member 1 at the lower edge 3 thereof. The space within the side wall protrusion 4 serves to embrace the upper part of a safety ring of synthetic material as will be described hereinafter. See, e.g., FIGS. 6–8.

Figure 2:
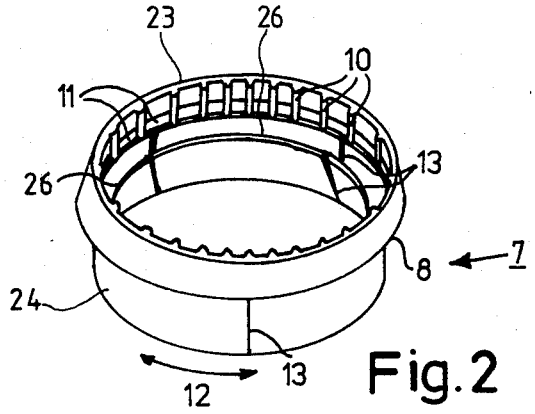
FIG. 2 is a perspective view of a ring of synthetic material with a Z-shaped cross section for the lid according to the invention.

In FIG. 2, a ring 7 of synthetic material, separate from the lid member 1, is shown in a perspective view for the lid according to the invention. The ring 7 of synthetic material has a Z-shaped cross section, as best seen by reference to FIG. 6, with an upper part 23 and a lower part 24 thereto. This ring of synthetic material is provided, in the inside of the upper part 23, with a plurality of spacing strips 10 transverse to the circumference 12 of the ring connecting the upper part 23 and lower part 24, and fracture lines 11 in the form of thin gaps between parts 23 and 24 in the direction of the circumference 12. See also, e.g., FIG. 4. The upper part 23 also has an outwardly protruding edge 8. In the lower part 24 of ring 7, there is provided an oblique radially-inwardly extending lip 26 and three equally spaced weakening lines 3 which are arranged transversely to the direction of the circumference 12 and which continue into the lip 26. If this ring 7 of synthetic material is placed into the lid member 1, so that the outwardly protruding edge 8 of the ring 7 is engaged by the inside of the protrusion 4, a lid is formed which can be fitted onto a container having a thread or undercut shoulder. To assemble, one proceeds according to one of the assembly methods as will be described hereinafter; if necessary, a thread that fits the thread of the container neck has to be flanged or pressed into the sidewall 32 of the lid member 1. See, e.g., FIG. 6.

Figure 3:
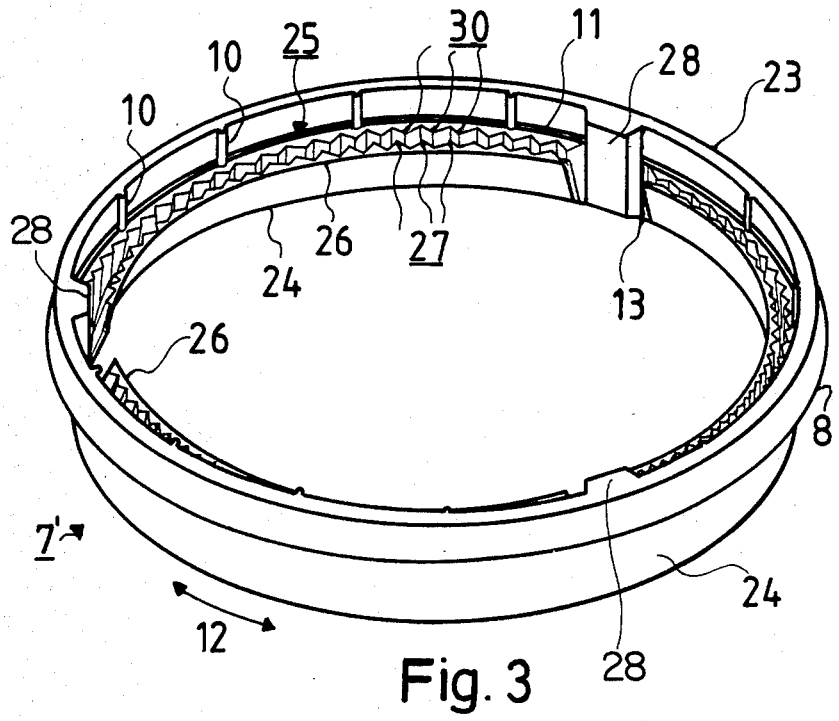
FIG. 3 is a perspective view of a ring of synthetic material, but with rigid support bridges between the upper and the lower part, for the lid according to the invention.

In FIG. 3, a ring 7′ of synthetic material is shown, similar to ring 7 of FIG. 2, but ring 7′ has special toothing between the lip 26 and the other portion of the lower part 24, as well as rigid support bridges 28. The upper part 23 and the lower part 24 are joined together by the rigid support bridges 28. The support bridges 28 are stronger than the much thinner spacing strips 10, which strips 10 have to tear apart when the lid or cap member 1 is screwed off. The support strips 28 must not tear apart, however. A region 25 of reduced resistance between upper part 23 and lower part 24 is formed by the separating strips 10 interrupted by fractured lines in the form of thin gaps 11. A weakening line 13 also is situated in the lower part 24 of the ring 7′ of synthetic material and extends transversely to the direction of the circumference 12.

At the weakening line 13, the lower part 24 can tear off from the support bridge 28, in the same way as the separating strips 10 can tear apart, when the container is opened. Consequently, this lower part of the ring is joined to the upper part at the other end only by another support bridge 28 which is not provided with such a weakening line 13. Grooving 30 is formed circumferentially on the inside of the outer, lower part 24 of the ring 7′ facing the lip 26. The lip itself is provided on the outside circumferentially with toothing 27 facing the grooving 30. Teeth 35 of the toothing 27 face corresponding grooves 34 of the grooving 30. If the lip 25 is pressed outwardly by the container neck, in particular by the container threads or undercut, when the ring of synthetic material is slipped over the container neck, the lip can give way into the grooves 34 of the grooving 30, in spite of the lip's stiffness from the teeth 35, just like the stiffness of the outer, lower part of the ring.

Figure 4:
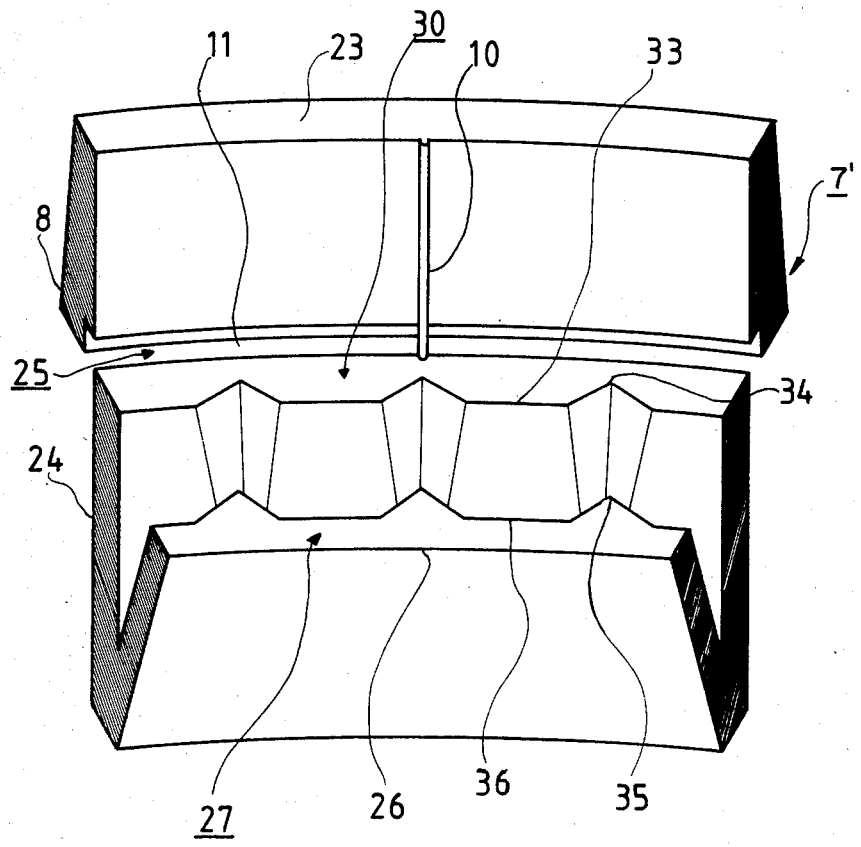
FIG. 4 is a perspective view in enlarged section, illustrating the ring of synthetic material according to FIG. 3.

In FIG. 4, an enlarged section of the ring 7′ of synthetic material of FIG. 3 is shown. FIG. 3 shows very distinctly that the separating strip 10 forms only a very thin joining line or strip between the upper part 23 and lower part 24 of the ring 7′. Therefore, the lid tears open easily. The grooves 34 converge downwardly to the lower part 24; the same applies for the teeth 34, which are, of course, not visible. Therefore, the grooves 34 and the teeth 35 are prevented from continuing into the nod or fold in the lower part 24. In each case, a groove 34 faces a tooth 35. Accordingly, a ridge 33 of the grooving 30 faces a recess 36 formed between the teeth 27 in every case. Upon opening, the teeth 35 engage grooves 34 and the ridges 33 engage recesses 36. In this way, while the lip 26 has only half the strength compared with a conventional lip, it has practically the same stiffness. Therewith, the toothed lip can give outwardly extremely far into the outer portion of the lower part 24, yet still maintain a rigid clamping or hooking effect to the container neck.

Figure 5:
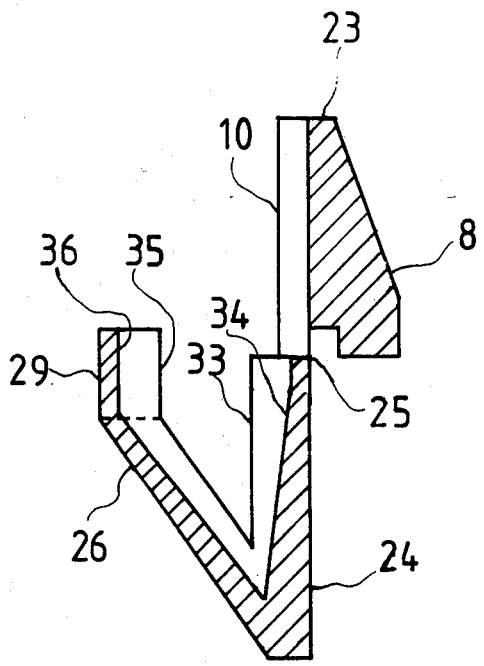
FIG. 5 is a cross-sectional view of a ring of synthetic material with elongations on the lip for the lid according to the invention.

Another embodiment of a ring of synthetic material according to the invention is shown in FIG. 5. In this case, bracing is obtained solely by the particular elongation tongues 29. These elongation tongues can be attached to the lower part 24, more or less parallel to the lip 26, in a scattered way, thus separated from the rest of the lip 26. A cross section of this ring of synthetic material is shown in FIG. 5, where the cross section cuts through an elongation tongue 29.

Figure 6:
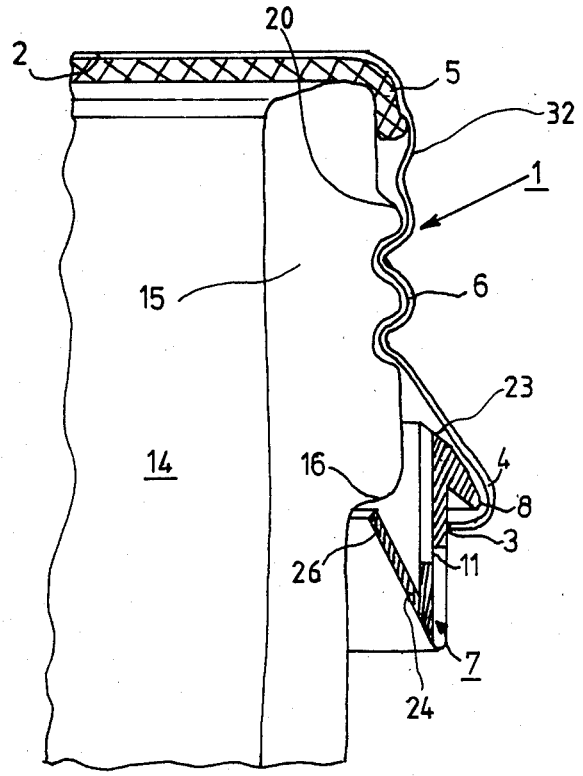
FIG. 6 is a cross-sectional view of a ring of synthetic material with a Z-shaped section, as it is fitted onto a container neck for a lid according to the invention.
Figure 7:
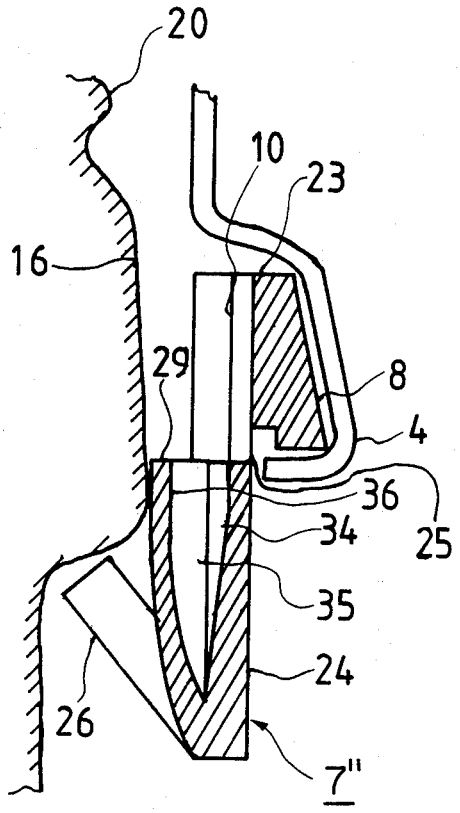
FIG. 7 is a fragmented cross-sectional view of the ring of synthetic material shown in FIG. 5 provided with elongation tongues on the lip, as it is fitted onto a container neck, for a lid according to the invention.

In FIG. 6, there is shown a section of a lid member 1 put onto a container 14 having container neck 15 together with a ring 7' of synthetic material having a Z-shaped cross section. Threads 6 of the lid or cap member 1 are already flanged into the side wall 32 of the lid corresponding to threads 20 of the container neck. The edge of the opening of the container neck 15 is sealed under the top cap, lid or cover portion 2 by a packing 5. Below the threads 20 of the container neck there is provided a shoulder 16 on the outside of the container neck 15. Shoulder 16 serves as a bar to the inwardly, obliquely upwardly directed lip 26 of the ring of synthetic material 7. On the outside of the protrusion 4 and below the lower edge 3 of the lid member 1, there is the circumferential region 25 of reduced resistance of the ring 7 comprising the strips 10 and the fracture lines 11 in the form of thin gaps between the upper part 23 and lower part 24 as previously described. The outwardly directed edge 8 of the upper part 23 of the ring 7 is situated inside the protrusion 4. By this cross-sectional presentation in FIG. 6, the grapple hook effect from the Z-shaped cross section of the ring 7 is evident. When the lid member 1 is screwed off upwardly, the lip 26 is held back by the shoulder 16; as the upwardly pulling force increases, the more effectively the lip 26 is pressed to the lower part of the shoulder 16. The same applies to the outwardly directed edge 8, which also has a grapple hook effect against the protrusion 4. Eventually the lower part 24 of the ring is torn off from the upper part 23 along the circumferential region 25 of reduced tear resistance and the lid member 1 can be taken off the container neck 15 together with the upper part 23 which remains in the protrusion 4.

In FIG. 6, the ring 7" of synthetic material similar to that shown in FIG. 5 is illustrated, by which a stressing is obtained by elongation tongues 29. These elongation tongues 29 can be attached to the lower part 24, arranged parallel to the lip 26 in a scattered way, thus separated from the rest of the lip 26. The tongues 29 are too long to fall below the shoulder 16, like the other lips 26 shown under the shoulder 16. Instead, the tongues 29 press with their free ends against the shoulder 16. It is advantageous to provide these elongation tongues 29 with teeth just like the lip 26 shown in FIG. 4, which are, on the other side, in correspondence with a grooving in the outer, lower part 25. In this FIG. 6, it is shown in cross section how the tooth 35 on the side on the elongation tongue 29 extends into the groove 34 on the inside of the outer, lower part 24. If the upper part 23 is joined to the lower part 24 by rigid support strips (not shown), the torn open parts of the lower part 24 of the ring 7 break off at suitable weakening lines or regions 25 as earlier described. As the individual parts of the safety ring 7 are joined tightly to the upper part 23 in the bulging 4 of the lid 1 by the support strips 10, they indicate or signal that a safety ring is present, which is now, of course, torn open. Accordingly, the user cannot be misled by a pretense that a bottle never had a safety ring of synthetic material.

Figure 8:
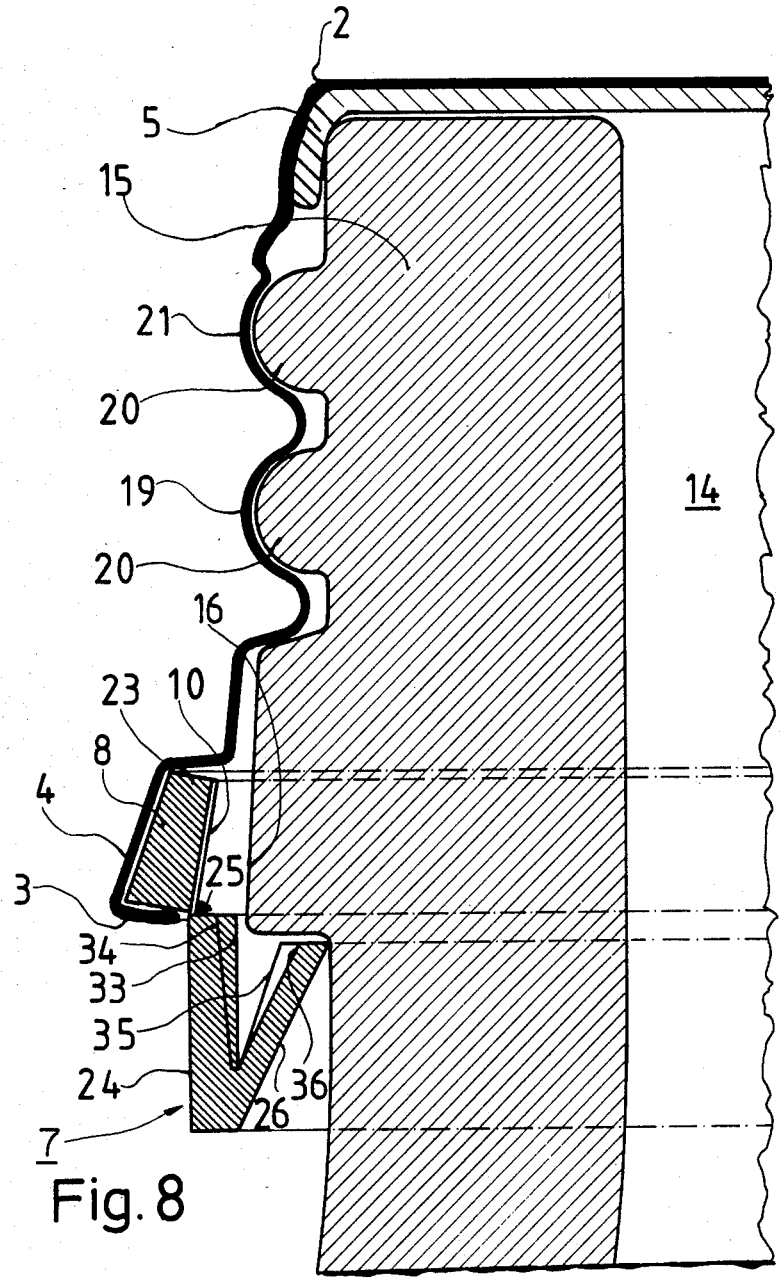
FIG. 8 is a cross-sectional view of a ring of synthetic material, as it is fitted onto a container neck, for a lid according to the invention, the upper part of the ring being braced by the inwardly inclined protrusion of the lid.

In FIG. 8, a ring of synthetic material 7 can be prestressed by a deforming or shaping of the protrusion 4. In FIG. 8, it is apparent how the protrusion 4 is inclined to the inside from the lower edge 3 of the lid member in an upward direction. This incline is also forced onto the upper part 23 of the ring of synthetic material 7. Consequently, it is stressed in such a way that it attempts to carry this incline over to the lower part 24. The protrusion 4 is compressed in its upper region and stretched in its lower region. However, the lower part 24 of the ring 7 cannot change its diameter at this stage. It is thus advisable to take care not to put any stress on the circumferential region 25 of the reduced tearing resistance of the ring, if possible. Otherwise, the lower part 24 could be torn off unintentionally as a result of such stress. However, the inwardly flanged edge 3 of the lid can be pressed upwardly, exactly by this arrangement; an extension of the circumference of this edge 3 is to be prevented in this case. Of course, the lower part 24 can be expanded or pressed together to a certain extent, also in the region 25 of reduced resistance. If now the lower part 24 of the ring is torn open at any weakening line 13 arranged transversely to the direction of the circumference when opening the lid member 1, the stress manifested as a slanted position of the upper part 23 will be carried over to the torn lower part 24 through the rigid support strips 28. consequently, this torn lower part inevitably attempts to lie parallel to the upper part 23; as a result, the torn open parts of the lower part 24 of the ring spread out from the container neck over the edge 3 of the lid. Consequently, the torn open parts of the lower part 24 cannot be pushed back toward the container neck to fake or resemble an untorn ring of synthetic material.

The new lid according to the invention is especially suitable for sealing carbon dioxide containing fluids, like mineral water or corresponding beverages, and has the above-described advantages over the prior art.

We claim:

1. A two-piece lid for a container neck provided with a thread or undercut shoulder comprising:

(a) a lid member having a lower circumferential side edge and a circumferential sidewall protrusion extending outwardly at the lower edge of the lid member for defining therein a ring-positioning space; and (b) a ring of synthetic material of a substantially Z-shaped cross-section including (i) an upper part, the upper part having a circumferential protrusion for fitting into the ring-positioning space and acting outwardly against the sidewall protrusion, (ii) a lower part having a lip protruding obliquely upwardly and inwardly for acting beneath the container neck shoulder, the lower part having no outwardly extending protrusion, and (iii) an intermediate circumferential region of reduced tear resistance during opening of the lid, the intermediate region being located between the upper and lower parts of the ring and positioned at or below the lower edge of the lid member.

2. A lid according to claim 1, in which the protrusion of the lid member is shrinkable.

3. The lid of claim 2, further comprising at least one weakening line formed on the lower part of the ring arranged transversely to the circumferential direction of the ring.

4. A lid according to claim 1, in which at least the lower part of the ring is shrinkable.

5. A lid according to claim 4, in which the protrusion of the lid member is shrinkable.

6. A lid according to claim 5, further comprising teeth formed on an outward portion of the lip and grooving formed on an inward portion of the lower part of the ring facing the lip and teeth for engaging the teeth when the lip is moved outwardly.

7. A lid according to claim 6, further comprising at least one weakening line formed on the lower part of the ring arranged transversely to the circumferential direction of the ring.

8. A lid as claimed in claim 7, in which there are between one and nine weakening strips.

9. A lid according to claim 6, further comprising at least one support bridge on the ring arranged transversely to the circumferential direction of the ring for joining the upper part and the lower part, and at least one weakening line formed on the lower part of the ring and arranged transversely to the circumferential direction of the ring.

10. A lid according to claim 9, further comprising support bridges arranged transversely to and spaced along the circumferential direction of the ring for joining the upper part and the lower part of the ring, and a weakening line formed on the lower part of the ring and arranged transversely to the circumferential direction of the ring adjacent one of the support bridges.

11. A lid according to claim 10, further comprising scattered elongation tongues extending from the lower part of the ring substantially upwardly and parallel to the lip for pressing against the container shoulder.

12. The lid of claim 1, wherein the lid member is formed of a metal.

13. The lid of claim 1, further comprising teeth formed on an outward portion of the lip and grooving formed on an inward portion of the lower part of the ring facing the lip and teeth for engaging the teeth when the lip is moved outwardly.

14. The lid of claim 1, further comprising at least one weakening line formed on the lower part of the ring arranged transversely to the circumferential direction of the ring.

15. The lid of claim 1, further comprising at least one support bridge on the ring arranged transversely to the circumferential direction of the ring for joining the upper part and the lower part, and at least one weakening line formed on the lower part of the ring and arranged transversely to the circumferential direction of the ring.

16. The lid of claim 1, further comprising support bridges on the ring arranged transversely to and spaced along the circumferential direction of the ring for joining the upper part and the lower part of the ring, and a weakening line formed on the lower part of the ring and arranged transversely to the circumferential direction of the ring adjacent one of the support bridges.

17. The lid of claim 1, further comprising scattered elongation tongues extending from the lower part of the ring substantially upwardly and parallel to the lip for pressing against the container shoulder.

18. The lid of claim 1, in which the protrusion of the ring, when positioned into the ring-positioning space defined by the sidewall protrusion of the lid member, is inclined inwardly in the upward direction along the entire ring circumference.

19. The lid of claim 1, wherein the sidewall protrusion of the lid member is inclined toward the inside from the lower edge of the lid member in an upward direction such that the protrusion of the ring, when positioned in the ring-positioning space defined by the sidewall protrusion of the lid member, is inclined inwardly in the upward direction along the entire ring circumference.

20. A two-piece lid for a container neck provided with a thread or undercut shoulder comprising:

(a) a lid member having a lower circumferential side edge and a circumferential sidewall protrusion extending outwardly at the lower edge of the lid member for defining therein a ring-positioning space; and (b) a ring of synthetic material including (i) an upper part, the upper part having a protrusion for fitting into the ring-positioning space and acting outwardly against the sidewall protrusion of the lid, (ii) a lower part of the ring shrinkable in a circumferential direction for acting beneath the container neck shoulder, and (iii) an intermediate circumferential region of reduced tear resistance during opening of the lid, the intermediate region being positioned between the upper and lower parts of the ring at or below the lower edge of the lid member.

21. The lid of claim 20, wherein the lid member is formed of a metal.

22. The lid of claim 20, further comprising at least one weakening line formed on the lower part of the ring arranged transversely to the circumferential direction of the ring.

23. The lid of claim 20, further comprising at least one support bridge on the ring arranged transversely to the circumferential direction of the ring for joining the upper part and the lower part, and at least one weakening line formed on the lower part of the ring and arranged transversely to the circumferential direction of the ring.

24. The lid of claim 20, further comprising support bridges on the ring arranged transversely to and spaced along the circumferential direction of the ring for joining the upper part and the lower part of the ring, and a weakening line formed on the lower part of the ring and arranged transversely to the circumferential direction of the ring adjacent one of the support bridges.

25. The lid of claim 20, in which the protrusion of the ring, when positioned in the ring-positioning space defined by the sidewall protrusion of the lid member, is inclined inwardly in the upward direction along the entire ring circumference.

26. The lid of claim 20, wherein the sidewall protrusion of the lid member is inclined toward the inside from the lower edge of the lid member in an upward direction such that the protrusion of the ring, when positioned in the ring-positioning space defined by the sidewall protrusion of the lid member, is inclined inwardly in the upward direction along the entire ring circumference.

* * * * *